United States Patent [19]

McKee et al.

[11] 4,090,770

[45] May 23, 1978

[54] CONNECTOR COVER CONSTRUCTION

[75] Inventors: William H. McKee, West Covina, Calif.; Roy Witte, Rolling Meadows, Ill.

[73] Assignee: TRW Inc., Elk Grove Village, Ill.

[21] Appl. No.: 727,010

[22] Filed: Sep. 27, 1976

[51] Int. Cl.[2] ..... H01R 13/46

[52] U.S. Cl. ..... 339/206 R

[58] Field of Search ..... 339/103, 107, 206, 207, 339/208, 209, 210, 99 R

[56] References Cited

U.S. PATENT DOCUMENTS

| | | | |
|---|---|---|---|
| 3,858,960 | 1/1975 | Kunkle | 339/206 R |
| 3,920,306 | 11/1975 | Barnett | 339/107 |
| 3,958,853 | 5/1976 | Wilson | 339/209 |
| 3,966,293 | 6/1976 | Mathe | 339/103 R |

FOREIGN PATENT DOCUMENTS

| | | | |
|---|---|---|---|
| 2,436,298 | 2/1976 | Germany | 339/107 |

*Primary Examiner*—Neil Abrams

*Attorney, Agent, or Firm*—Neuman, Williams, Anderson & Olson

[57] ABSTRACT

A cover for a ribbon type connector having a plurality of wire-receiving channels defined by spaced barrier wall portions includes a channel-covering wall portion having projecting ribs mounted thereon. The ribs are received in the connector channels in the normal position of use and interlock with the channel wall portions by means of a tongue and groove interlock defined by projecting beads and recesses. Resilient latch portions formed at opposed end portions of the cover engage connector end portions and assist in maintaining a snug, connector cover interlocked assembly.

13 Claims, 11 Drawing Figures

CONNECTOR COVER CONSTRUCTION

This invention relates to a novel cover construction for use with multi-wire connectors, and more particularly pertains to a cover construction having a plurality of wire-retaining ribs which interlock with the engaged connector by means of a novel tongue and groove interlock.

In the use of ribbon type connector and termination systems known in the art, such as so-called miniature ribbon termination systems or high density systems, a plurality of wires are terminated in closely adjacent relationship. The individual wires in these systems may be connected to the individual connector contacts by various means such as by solder employing or solderless techniques. Following termination of the wires in many installations a cover may encompass the wire portions disposed in the connector terminals. The cover provides protection against inadvertent contact by extraneous conductive elements and against damage to the encompassed connector and terminated wires.

In connectors in which it is desired to have a "half-tap" effected, that is, have each wire exit from the connector on each side of the wire portion engaging a terminal therein, it is necessary that a connector cover be employed which does not fully cover the connector channels in which the wire-engaging contacts are disposed. An opening should be provided between the cover and connector body through which the wire may exit after engaging a connector contact.

A connector cover also should permit the wires to approach the connector from a plurality of varied directions, as distinguished from connector hoods which typically admit the wires in a bundle through one opening.

In copending application Ser. No. 649,812 of William H. McKee, filed Jan. 16, 1976 now abandoned, one prior cover for a ribbon-type connector is disclosed. With that device, wires effecting half taps are retained by means of a flexible cover having ribs which interfit with connector channels containing wire-gripping terminals and wires engaged thereby. The cover ribs assist in retaining the wires in engagement with the connector terminals by resisting forces tending to remove the wires from the connector channels. In such a cover construction, locking of the cover to the connector is effected by latch portions defining distal cover ends which interlock with each other, and by means of enlarged cover ribs which effect a press fit with connector channels in the normal course of use.

Other cover constructions of the prior art include that disclosed in Roberts et al U.S. Pat. No. 3,824,530, granted July 16, 1974 which employs a transverse bar which overlies connector channels and wires disposed therein. Neither of the foregoing cover constructions provides the degree of wire retention within connector channels obtainable with the hereinafter described cover.

It is an object of this invention to provide an improved cover arrangement for connectors, and particularly to provide for positive intelocking engagement of the cover and the connector.

It is a further object of this invention to provide a cover and connector combination which will preclude spreading of the cover from the connector in a direction normal to the terminal channels.

It is another object of this invention to provide a novel cover construction which employs latch distal portions for purposes of engaging opposed connector end portions in a secure interlock.

It is still another object of this invention to provide a novel cover construction in which a novel interlock is effected with channel-defining barriers of a connector on one cover surface, and a retaining interlock is effected with wire portions disposed exteriorly of said connector on a second cover surface for desired wire positioning purposes.

The above and other objects of this invention will become apparent from the following detailed description when read in light of the accompanying drawings and appended claims.

In one embodiment of the provided invention, a multi-wire, ribbon-type connector having two opposed series of wire-receiving channels has the channel-portions thereof encompassed by two discrete cover sections, each cover section covering one of said channel series. Each cover has a plurality of parallel projecting ribs adapted to be received in a slidable interlock with channel-defining barrier portions of said connector. Said cover ribs and connector barriers have mating projecting beads and bead receiving recesses disposed along the length thereof to effect a secure tongue and groove interlock. In a position of use, the cover ribs are disposed over at least a major portion of a wire disposed in electrical engagement with a metal contact disposed in each of said connector channels. Such interlock prevents the cover from moving away or backing off from said connector channel-defining barriers other than by means of a slidable disengagement permitted through the channel open ends.

The opposed cover ends comprise latch portions having planar wall portions adapted to resiliently engage opposed end portions of said connector therebetween. Latch foot portions disposed at right angles to the latch wall portions interfit between the lower edge of a beveled ramp integrally formed at each connector end and the upper edge of a connector ledge so as to prevent movement of the cover along an axis parallel to the connector channels. A latch tab portion assists in preventing lateral cover movement as will hereinafter be explained in greater detail.

DESCRIPTION OF THE INVENTION

Figure 1:
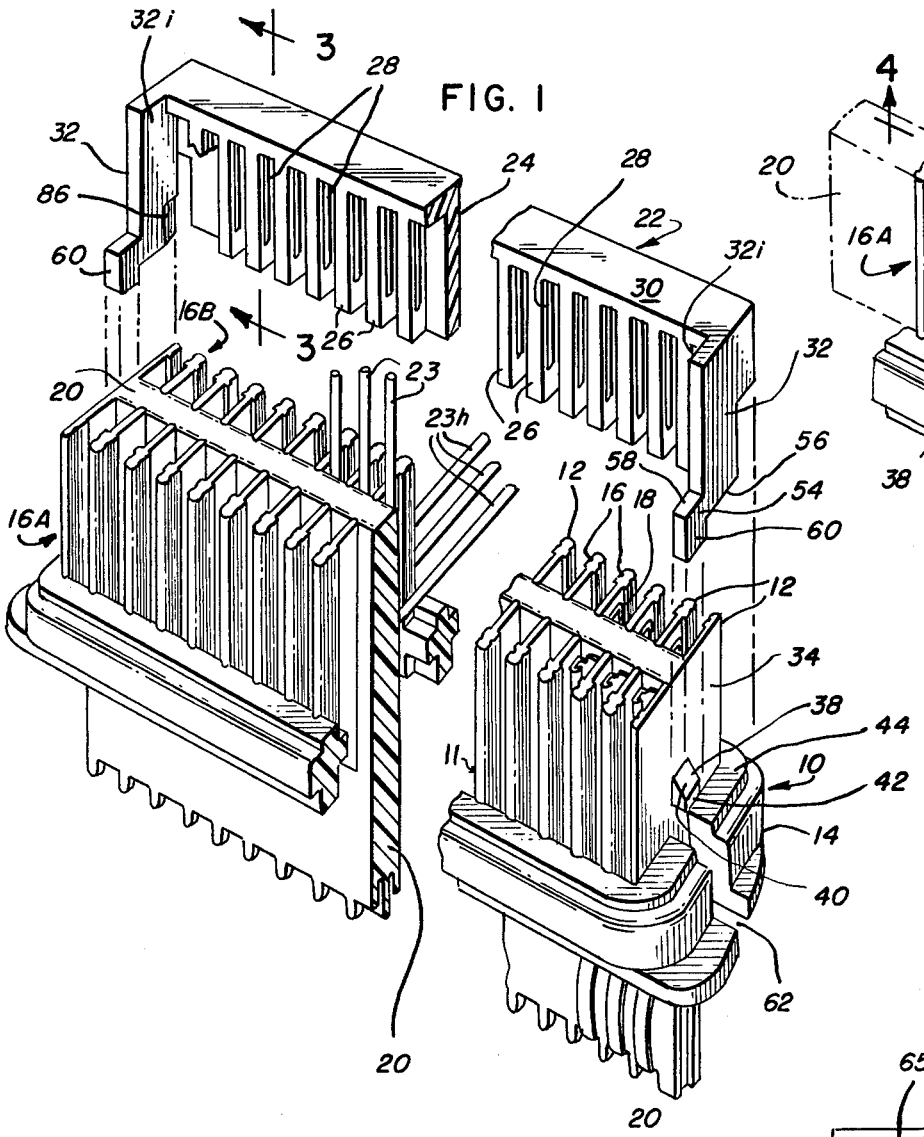
FIG. 1 is a fragmentary exploded view illustrating one embodiment of a cover made in accordance with the teachings of this invention prior to engagement with a ribbon-type connector.

Referring now more particularly to FIG. 1, a ribbon-type connector 10 is therein illustrated of a type well known in the art, and of a type manufactured by TRW Inc. of Elk Grove, Village, Illinois, and referred to as a Cinch Ribbon connector. Connectors of the general type illustrated are also manufactured by a number of other manufacturers and are adapted to be employed in so-called miniature termination systems, or high density systems in which a plurality of wires are terminated in close relationship. The individual wires may be connected to individual contacts by various means, such as by soldering or by a solderless technique, e.g., such as is disclosed in the McKee and Witte application Ser. No. 443,678, filed Feb. 19, 1974.

In FIG. 1 connector 10 includes an insulator body 11 and electrical contacts 18. The body 11 comprises a plurality of parallel barrier portions 12 and a central rib or wall 20 which extend from a central connector body portion 14 and which define parallel channels 16. Disposed in each channel 16 is a wire engaging contact 18 which may be formed of a suitable conductive metal. The contacts 18 are of the so-called solderless type to effect electrical contact with the conductor of a wire when the wire is urged or pressed laterally into the contact.

It will be noted from FIG. 1 that each connector 10 has two opposed sets or series of channels 16A and 16B extending from the central connector insulating wall 20. In accordance with this invention, after a plurality of wires such as wires 23 of FIG. 1 have been secured in electrical contact with the metal contacts 18 disposed in channels 16 of the connector 10, a cover member 22 is disposed over each series of connector channels 16A and 16B for purposes of detaining the wires within the channels and providing strain relief which prevents disengagement between the wires and the contacts 18.

It will be seen from FIG. 1 that each cover 22 comprises a planar face portion 24 from which projects a plurality of parallel spaced rib members 26. Each rib 26 has formed along opposed longitudinal surfaces thereof in parallel relationship projecting beads 28, see FIGS. 3 and 4. The ribs 26 are integrally formed with the face portion 24 and with a cover top portion 30 which extends along one edge of the face portion 24. The top surfaces of the ribs 26 are coplanar with the top surface of the portion 30.

Integrally formed with opposed longitudinal ends of the face portion 24 and the cover top 30 are opposed end latch portions 32. The interval between opposed inner surfaces 32*i* of the spaced latch portions 32 is such so as to snugly receive therebetween opposed end surfaces 34 of connector 10. These portions define the opposed end limits of the channel-defining portions 16A and 16B of each connector. Each end surface 34 of connector 10 has integrally formed therewith a ramp-shaped stop portion 38 having a downwardly and outwardly sloping surface 40 and a lower shoulder edge 42. The shoulder 42 is generally perpendicular to the barriers 12 and parallel to the surface of a central ledge portion 44 of the connector 10, and is disposed above the central body portion 14 of such connector.

Figure 4:
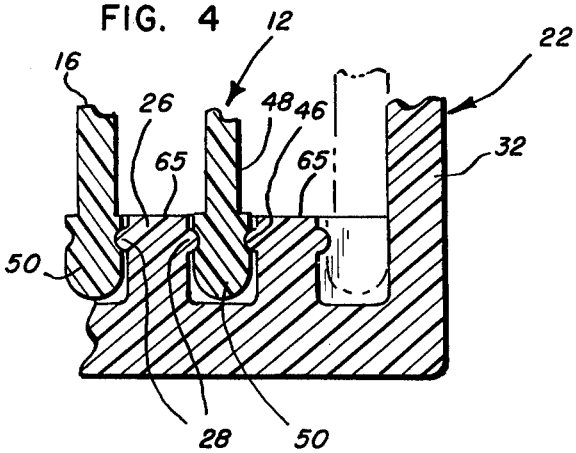
FIG. 4 is a fragmentary sectional view taken along the line 4—4 of FIG. 2.

It is the function of the bead portions 28 formed on opposed surfaces of each cover rib 26 to effect an interlocking engagement with opposed grooves or recesses 46 formed in opposed surfaces 48 of enlarged outer portions 50 of each connector barrier 16, as is also most clearly seen in FIG. 4 of the drawings.

In disposing a cover such as cover 22 on each series of channels 16A and 16B, each cover is moved downwardly parallel to the length of the connector barriers 12 and the channels 16 so that the beads 28 slidably engage grooves 46, see FIG. 4. In the process of sliding a cover 22 onto a connector 10, the opposed latch portions 32 of each cover 22 also slidably move over the opposed planar connector end wall portions 34. As the cover beads and connector recesses effect a tongue and groove interlock in the manner of FIG. 4, the opposed inner surfaces 32*i* of the cover latch portions 32 slidably move over surfaces 34 until an inwardly projecting foot portion 54 of each cover latching portion 32 is forced to move over the downwardly sloping surface 40 of a ramp lock 38. This mating movement is continued until each foot 54 passes over the respective lock 38, whereupon lower edge 56 of the foot portion 54 engages upper surface portion of the connector ledge 44 and upper surface portion 58 of the foot portion 54 is disposed beneath the lower edge 42 of the ramp 38 so that the latched relative disposition of FIG. 2 is assumed.

Figure 2:
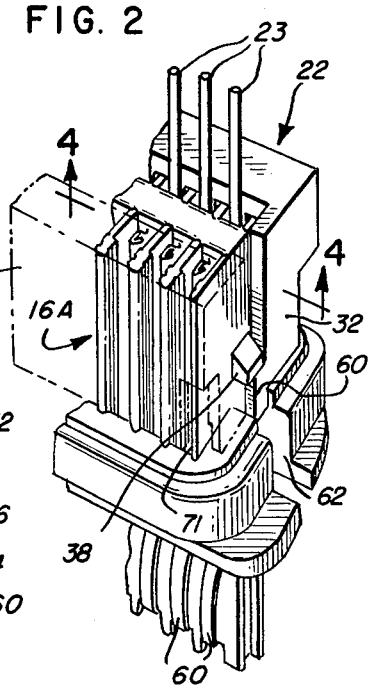
FIG. 2 is a fragmentary perspective view illustrating the cover and connector of FIG. 1 in interlocked engagement in the normal assembled position.

It will be further noted from both FIGS. 1 and 2 that a terminal tab portion 60 extends downwardly from an end portion of the latch projecting foot portion 54. Each tab 60 depends into an opening 62 centrally disposed along the longitudinal axis of the connector 10, and formed by a core member employed in the course of molding the connector 10. This design also permits formation of the shoulder 42 in a molded connector without side coring.

The opposed latch portions 32 integrally formed with each cover 22 may resiliently flex outwardly relative to the remainder of the cover with which formed. Thus the opposed latch foot portions 54 readily move slidably over the downwardly inclined surface portions 40 of each ramp 38 integrally formed on surface wall portion 34 of connector 10 until the upper edge portion 58 snaps beneath lower edge portion 42 of each ramp 38, as described. When foot portion 54 of each cover latch is locked between the ramp 48 and the upper surface of the connector ledge 44, undersurface portions of the top 30 of the cover 22 will be adjacent the upper end limits of the connector barriers in the manner illustrated in FIG. 2. In such disposition a cover-connector gap remains at the open outer ends of the channels 16 for wires 23 to enter the connector as seen in FIG. 2.

Since the connector barriers and the beads of the cover ribs are in the interlocking relationship most clearly seen in FIG. 4, each cover 22 will be prevented from moving outwardly relative to the connector barriers and channels, and the cover ribs will be securely disposed in each connector channel 16 for purposes of maintaining the wires 23 disposed therein in secure engagement with the metal contacts 18.

Foot portions 54 of latch portions 32 of the cover 22, when locked in the manner aforedescribed relative to ramp portion 38 and ledge 44 of each connector, will prevent the cover from moving axially relative to the connector with which engaged until foot portion 54 of each cover latch portion 32 is pried outwardly so as to clear its respective stop ramp 38. To facilitate such prying action, an inner surface edge portion of each latch foot and tab portion 54 and 60, respectively, may be relieved to facilitate insertion of a blade or the like for prying the tab and connected foot portion outwardly.

Figure 5:
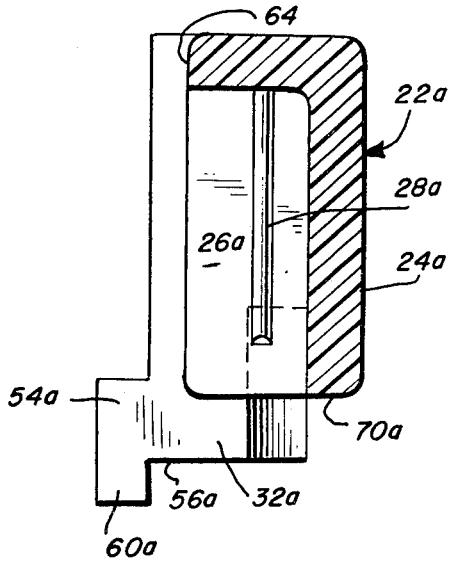
FIG. 5 is a fragmentary sectional view similar to FIG. 3 of a corresponding cover for a connector adapted to mate with the connector illustrated in FIG. 1.
Figure 6:
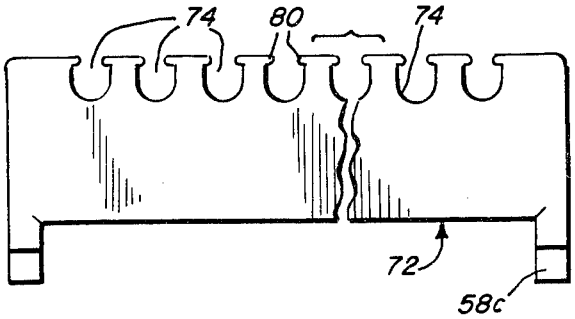
FIG. 6 is a top plan view of a modified cover construction made in accordance with the teachings of this invention.

FIG. 5 illustrates a cover 22*a* corresponding to cover 22 as modified for use with a female or socket version of the connector 10. The depths of the channels in connectors may vary, e.g., as between a male or plug connector such as illustrated in FIG. 1, and a female receptacle or socket connector (not illustrated). Thus it will be noted from FIGS. 3 and 4 that in conjunction with the illustrated male plug connector 10 the retaining edges 65 of ribs 26 project only a short distance into the channels 16 defined by the barriers 12. The channels of a female socket connector may be deeper, thereby requiring greater penetration of the cover ribs for purposes of effecting a desired wire retention function. Accordingly, ribs 26*a* of modified cover 22*a* in FIG. 5 are of greater depth than ribs 26 so that the forward wire-retaining edge surface 64 of each rib 26*a* will penetrate to a greater degree into the connector channels. The beads 28 and 28*a* formed on opposed surfaces of each cover rib are located and designed to interfit with the grooves in the respective ribs and may extend varying distances into the channels 16 of the connector with which employed.

Figure 3:
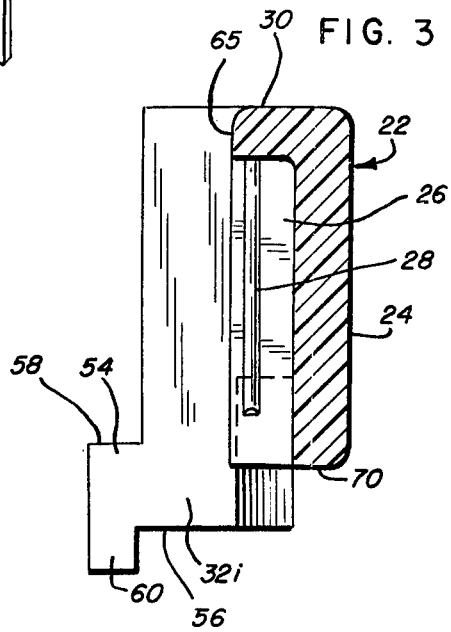
FIG. 3 is a sectional view taken along line 3—3 of FIG. 1.

It will be further noted in FIGS. 3 and 5 that the lower edge limits 70 and 70*a* of the portions 24 and 24*a* are spaced above lower edge surfaces 56 and 56*a* of the latch foot portion 54 and 54*a*, respectively. This assures the presence of an opening interval at the inner ends of the channels, such as at 71 beneath the cover 22*a* shown in phantom in FIG. 2. Thereby wires 23 which are half tapped, that is, which extend through the metal contacts 18 in the connector channels, may exit from the connector in the manner illustrated at 23*h* in FIG. 1. The wires 23 may pass from the connector 10 with the cover in the wire-retaining position of FIG. 2, passing beneath the lower end limits of the beads 28 and 28*a* of the covers 22 and 22*a* respectively and beneath the lower edge portions 70*a* and 70 of the connector walls 24 and 24*a*, respectively.

FIGS. 6 through 11 illustrate a modified cover construction 72 made in accordance with the teachings of this invention in which exterior grooves 74 are formed in rear surface portions of the cover. It is the function of the grooves 74 to receive and retain dressed wires 23 following the effecting of electrical contact with the metal terminals 18 in the connector channels 16. (Two wires 23 are illustrated in phantom lines in FIG. 9). To assist in retaining the wires 23 in the grooves 74, projecting tabs 80 are formed at the upper or outer end of each groove 74 in the manner most clearly seen in the front view of the cover 72, see FIG. 10. The front portion of cover 72 is defined by projecting ribs 76 (see FIGS. 7 and 9) having formed on opposed side surfaces thereof longitudinal beads 78 adapted to engage, in an interlocking tongue-and-groove relationship, grooved barriers such as those of connector 10 illustrated in FIG. 1, a barrier 12 being illustrated in phantom lines in FIG. 9. The thickness of the cover 72 of FIGS. 6 through 11 must contain not only the projecting ribs 76 disposed in the front surface of the cover 72 but also the wire-retaining grooves 74. Thus the thickness of the cover 72 will of necessity be greater than the thickness of the cover modifications 22 and 22*a* of FIGS. 3 and 5, respectively.

Figure 11:
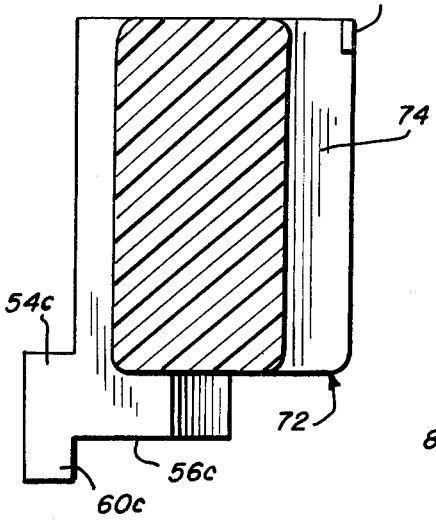
FIG. 11 is a sectional view taken along the line 11—11 of FIG. 10.
Figure 9:
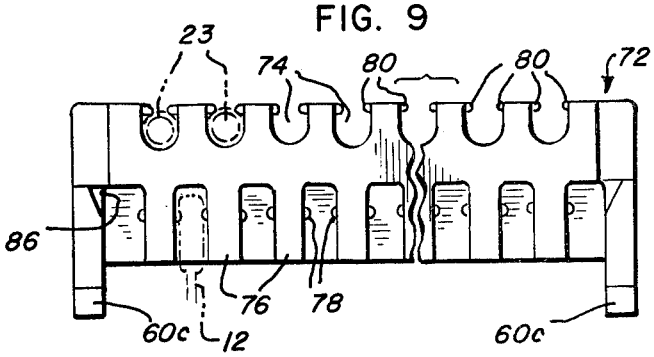
FIG. 9 is a bottom plan view of the modified cover construction of FIGS. 6 through 8.
Figure 8:
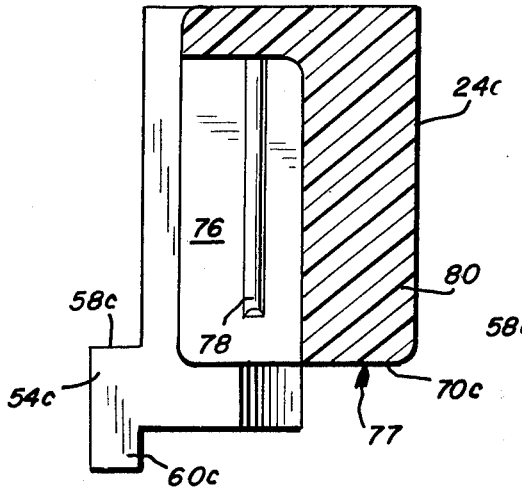
FIG. 8 is a sectional view taken along the line 8—8 of FIG. 7.

FIG. 8 is a sectional view illustrating a rib 76 of the cover 72 in elevation together with a longitudinal bead 78 formed thereon. The remaining body portion 82 of the cover of FIG. 8 contains the wire-dressing grooves 74. FIG. 11 is a sectional view of cover 72 illustrating a wire-receiving groove 74 in elevation. A wire-retaining tab 80 is also shown in elevation at the upper groove end.

The latch construction of the cover embodiment 72 of FIGS. 6 through 11 is the same as that of the cover embodiments 22 and 2*a* and will engage a connector such as connector 10 of FIG. 1 in the same manner as previously described with respect to cover 22. The latch components of the connector 72 bear the same identifying numerals as the latch 22 of FIG. 3 together with the suffix "C."

Figure 7:
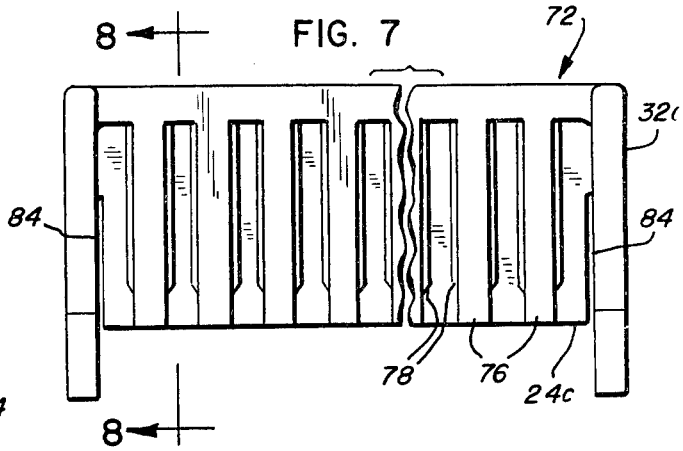
FIG. 7 is a rear view of the cover construction of FIG. 6.
Figure 10:
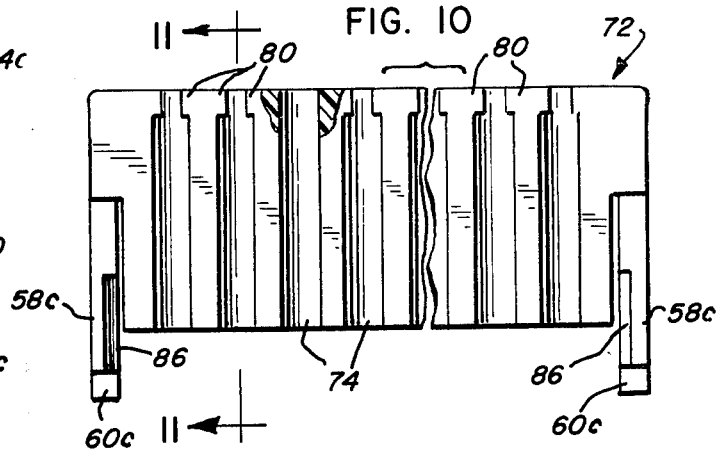
FIG. 10 is a front elevational view of the cover construction of FIGS. 6 through 9.

The central planar portion of each latch portion 32 of cover 22 of FIGS. 1 through 4, and of cover 22*a* of FIG. 5, and of cover 72 of FIGS. 6 through 11, is separated from the adjacent cover back portion over a substantial portion of the latch by means of a separating slot 84 (FIGS. 7 and 10). The slot enables the cover latch walls to flex outwardly in the course of moving over the downwardly sloping surface 44 of each ramp 38 (FIG. 1). Slot 84 illustrated in FIG. 7 is shown between the end latch portion 32*c* and the adjacent cover rear wall portion 24*c*.

Also shown in FIGS. 7 and 10 are relieved portions 86 of the latch foot portions 54*c* which facilitate the insertion of a knife blade or the like for purposes of outwardly flexing the foot portions 54*c* while moving the cover 72 and disengaging the same from an engaged connector ramp.

Although the foregoing description has described the projecting beads as being formed on the cover ribs and the receiving recesses as being formed on the channel-forming barriers 12 of the connector illustrated in the drawings, it is apparent that the projecting beads may be formed on the connector barriers 12 and the receiving recesses formed on the cover ribs. However, the illustrated arrangement is preferred as it maintains maximum width of the channels 16 and therefore does not interfere with placement of the wires in the contacts.

It is apparent from the foregoing description that in accordance with this invention an interlock is effected between mating projections and grooves on the ribs of a cover member and the barrier channel-defining portions of a connector. These two elements thereby effect a desired positive retention interlock by means of a tongue-and-groove engagement. The specific configuration of the projection and the receiving openings or slots is not of critical importance and the same may depart from the specific bead and recess configuration illustrated in the drawing without departing from the spirit of this invention.

It is also seen from the foregoing that by means of the novel tongue-and-groove interfit described, each rib is positively locked in place, solving all problems of lateral strain. Thus, the interlock between the cover and connector is such as to resist any removal force exerted on the covers due to sideways pull on the wires such as may occur in dressing half tapped connections. Although it is preferred that the provided covers have ribs projecting into each connector channel, a cover having spaced ribs which engage spaced channels defined by spaced barrier pairs will also work to advantage.

It is apparent from the foregoing description that the latch portions of the subject cover constructions also provide retention against end-wise wire withdrawal parallel to the connector channels by virtue of the novel foot-ramp engagement. In addition the projection of the tab portion of each cover latch portion into the slot of the connector body tends to prevent the cover latches from being moved sideways under the ramp lower edge surfaces, and thereby assists in preventing inadvertent unlatching. Such unlatching might occur from a normal rotational moment when an upward force is applied to the cover.

The above-described cover and connector constructions may be readily formed by simple molding operation, utilizing electrically insulative plastic.

Although the foregoing description has been specific with respect to a single cover member, it is apparent that in the normal course of use two covers will be employed with each connector, covering the opposed series of connector channels such as the series 16A and 16B of FIG. 1. Each slot 62 formed along the central axis of the illustrated connector is of such width as to snugly receive both of the respective projecting tab portions 60 of a pair of opposed cover members 22 in abutting engagement. Thus when the opposed covers are in their normal wire-retention positions, they will appear in the positions of cover 22 illustrated in FIG. 2 and the cover *22a* illustrated in phantom lines in FIG. 2.

It is believed apparent that a number of modifications of the cover and connector constructions described above in detail may be made by those skilled in the art particularly in light of the teachings outlined herein. It is intended, therefore, that the scope of this invention be limited only by the hereinafter appended claims.

What is claimed is:

1. The combination comprising a multi-wire connector having a series of parallel wire-engaging channels, each of said channels being defined by parallel barrier wall portions and having a wire-engaging means disposed therein between said wall portions; a cover means adapted to overlie said connector channels and having projecting ribs receivable in said connector channels between said barrier wall portions; said barrier wall portions of said connector and said projecting ribs of said cover means being predeterminately formed to effect an interlock when said cover ribs are received in said connector channels with the longitudinal axes of said cover ribs and connector channels in parallel relation, to prevent disengagement between said ribs and channels other than by relative slidable movement parallel to said rib and channel longitudinal axes.

2. The combination of claim 1 in which said barrier wall portions and cover means ribs are predeterminately formed to define interlocking elements of said connector and said cover including projections formed on one of said interlocking elements and openings adapted to receive said projections formed on the other of said interlocking elements.

3. The combination of claim 1 in which said channel-defining wall portions of said connector have grooves formed therein, and said cover ribs have projecting beads formed on surface portions thereof; said beads being received within said grooves when said cover ribs are disposed in said connector channels.

4. The combination of claim 3 in which said barrier grooves and said cover beads extend in parallel relation with said channels, and said cover engages said connector channels in interfitting engagement by insertion of the cover ribs in the open ends of the channels.

5. The combination of claim 1 in which spaced latch portions define opposed end portions of said cover means; said portions having an interval therebetween of such magnitude as to snugly receive the opposed ends of said connector therebetween when said cover means is in the normal position of interfitting use with said connector channels.

6. The combination of claim 5 in which said latch means comprises opposed planar end portions extending in substantially parallel relation with said connector channels; each of said end portions having a projecting foot portion extending transversely to the longitudinal axis of said connector; a lug disposed on opposed end surface portions of said connector, ledge means spaced from a surface of said lug means defining an interval therebetween in which said latch means foot portion is received; said foot portion-lug engagement preventing axial withdrawal of said cover means ribs from said connector channels.

7. The combination of claim 6 in which a terminal tab is integrally formed with an end portion of the latch means foot portion, said terminal tab projecting from said foot portion in a direction oppositely disposed to said latch means planar portions; said terminal tab being received in a connector recess disposed in axial alignment with one of said connector lugs.

8. The combination of claim 1 in which said cover means does not cover the entire length of each of said connector channels in the normal course of use whereby wires terminated in said connector channels may enter said channel open ends and exit said channels from uncovered side portions thereof.

9. The combination of claim 1 in which said barrier wall portions of said connector and said projecting ribs of said cover means include portions of complementary configuration extending substantially parallel to the longitudinal axes of said cover ribs and connector channels for interlocking tongue and groove engagement therebetween by insertion of said cover ribs into said connector channels in a direction parallel to said axes.

10. The combination as in claim 9 wherein the maximum lateral dimension of each of said ribs at said portions thereof exceeds the minimum lateral dimension between said wall portions defining each of said channels.

11. The combination comprising a connector having a plurality of open-ended, wire-receiving channels; a wire engaging means disposed in each of said channels; parallel planar wall portions defining opposed end surfaces of said connector, ramp means projecting from each of said planar wall portions and sloping away from the channel open ends, a planar ledge extending at substantially right angles to the planes of said wall portions and spaced beneath each of said ramp means; each of said ramp means defining a slot with each of said planar ledges adapted to receive a cover means portion therein in interlocking relation; a cover having a plurality of projecting ribs extending from a main surface thereof, and having opposed planar end surfaces adapted to resiliently receive said connector planar wall portions therebetween; said cover projecting ribs and the connector channel-defining portions being predeterminately formed to effect an interlock when said cover ribs are slid into said connector from the channel open ends; each of said cover planar wall portions having a projecting foot portion adapted to slide over a connector ramp means and snap into one of said slots in the normal position of connector-cover assembly; each cover foot portion having a projecting tab downwardly projecting in a direction opposite to said connector channel open ends and at substantially right angles to said slots; a central recess disposed in each of said connector ledges in axial alignment with a central portion of each of said ramp means; a projecting tab portion of said cover being disposed in said central recess in the normal position of cover-connector assembly.

12. The combination of claim 11 in which said connector has opposed series of open-ended, open-sided channels and a separate cover engages each series of channels; distal edge portions of the projecting foot portions of said covers abutting in said slots in the normal position of connector cover assembly.

13. In combination a connector construction comprising a body portion having a plurality of open-ended, open sided, wire-receiving channels; wire engaging means disposed in each of said channels, parallel barrier wall portions defining each of said channels; grooves formed in each of the channel-defining barrier wall portions; said grooves extending from the channel open ends, a cover adapted to cover at least portions of the channel open sides; said cover having a planar body portion; projecting ribs projecting in parallel alignment from said body portion; laterally projecting beads extending from opposed side surfaces of each of said ribs; and ribs being adapted to enter said connector channels through the open ends thereof and interfit with said connector barrier wall portions; said laterally projecting beads being slidably received in said wall portion grooves when said ribs enter said channels so as to prevent relative movement between said connector and said cover other than by slidable movement along an axis parallel to said cover ribs and said connector channels.

* * * * *